US005303492A

United States Patent [19]

Nishio

[11] Patent Number: 5,303,492

[45] Date of Patent: Apr. 19, 1994

[54] RETROFLECTIVE ROAD SIGN HAVING TRANSLUCENT BORDER AROUND LEGEND SEGMENTS

[76] Inventor: Dan Nishio, 190 Flying Cloud Isle, Foster City, Calif. 94404

[21] Appl. No.: 964,369

[22] Filed: Oct. 21, 1992

[51] Int. Cl.[5] ..... G09F 13/16

[52] U.S. Cl. ..... 40/582; 40/612; 359/529; 428/172

[58] Field of Search ..... 40/582, 583, 612, 580, 40/615; 359/528, 529, 530; 428/172, 913

[56] References Cited

U.S. PATENT DOCUMENTS

| | | | |
|---|---|---|---|
| 1,878,909 | 9/1932 | Stimson | 359/528 |
| 1,893,024 | 1/1933 | Gill . | |
| 1,950,560 | 3/1934 | Martinek et al. | 359/528 X |
| 2,012,933 | 8/1935 | Davidson | 359/528 X |
| 2,910,792 | 11/1959 | Pfaff | 40/130 |
| 3,359,671 | 12/1967 | Nier | 40/615 |
| 4,846,549 | 7/1989 | Gutsche | 350/101 |
| 5,050,327 | 9/1991 | Woltman | 40/582 |
| 5,122,902 | 6/1992 | Benson | 359/529 |

*Primary Examiner*—Brian K. Green

[57] ABSTRACT

A road sign for clearly presenting an informational legend to a viewer in front of the sign under direct and back lighting conditions, comprising an aluminum background sheet (10) having a cutout (12) in the shape of the legend (11). A retroreflective portion (14) is sized and shaped such that when the retroreflective portion is placed into the cutout, a uniform gap is left between the portion and the cutout. A translucent sheet (13) is mounted behind the background sheet and the retroreflective portion such that a translucent border (15) is visible from in front of the sign. When the sign is illuminated by direct lighting such as a driver's own headlights, the retroreflective portion will reflect much of the light such that the legend will be clearly visible to the driver. When the sign is illuminated by strong back lighting such as a low sun or oncoming headlights, the translucent border of the legend will glow brightly such that the message will be clearly seen by the driver as an outline of the legend.

3 Claims, 2 Drawing Sheets

RETROFLECTIVE ROAD SIGN HAVING TRANSLUCENT BORDER AROUND LEGEND SEGMENTS

FIELD OF THE INVENTION

This invention relates generally to signs, specifically to an improved traffic sign.

BACKGROUND OF THE INVENTION

Conventional traffic or road signs currently in widespread use are made of a strong metal sheet or backplane supported on a post. The backplane is painted with a background color, while the words and symbols, or informational legend, are painted over the background in contrasting colors. A typical example is a "STOP" sign, which has an octagonal backplane with a red background, a white border around the backplane, and the word "STOP" in white letters. The chosen colors of these road signs are intended to be conspicuous so that the signs are easily noticed by drivers, while the color combinations are highly contrasting so that the information can be easily discernible from a distance. In addition, the paints used on the signs are substantially reflective such that at night, when they are directly illuminated by approaching headlights, they reflect much of the light back to the drivers. Therefore, the signs should theoretically be highly legible in the dark.

In practice, the readability of conventional signs depend upon the actual viewing conditions. The signs are adequately legible when their front faces are illuminated by frontal or direct lighting during the day, and direct lighting by headlights during the night. However, if they are predominately illuminated from the back, or backlit, by the sun, a bright haze, or oncoming headlights, the areas surrounding the signs can appear very bright, while the faces of the signs can appear so dark that they can become unreadable.

Some signs have been designed to alleviate this back lighting problem. U.S. Pat. No. 5,050,327 to Woltman (1991) shows a sign with legend segments or letters which are mostly retroreflective, but somewhat translucent. Under direct lighting, the legend will reflect much of the light such that it will be highly visible. On the other hand, when the sign is backlit by the sun or oncoming headlights, the slightly translucent legend will allow some of the light to pass through so as to make the legend glow against the dark background of the sign. The glowing message will allow the sign to be more readily readable when backlit. However, utilizing the retroreflectivity and translucency of the same material has a tradeoff. The more retroreflective the material, the less translucent it is, and vice versa. Therefore, the readability of the sign will be highly compromised, such that it will either be very readable in direct lighting, but not in back lighting, or it will be very readable in back lighting, but not in direct lighting.

U.S. Pat. No. 4,846,549 to Gutsche (1989) shows a display device, in FIG. 3, which has entirely translucent legend segments. When strongly backlit, lenses behind the translucent segments focus light onto the segments as bright spots, such that the segments appear as lines of bright dots. However, this sign will only work in this manner if the back lighting occurs at almost normal to the plane of the sign, otherwise the focal points of the lenses will not fall onto the translucent segments. Moreover, the purely translucent segments will reflect little light, such that they will be very difficult to read in direct or oblique lighting.

In conclusion, no existing sign is highly readable in direct, oblique, and back lighting conditions.

SUMMARY OF THE INVENTION

Accordingly, several objects and advantages of the invention are to provide a sign which is clearly readable in direct, oblique, and back lighting conditions, which may be clearly seen from various angles, which may be customizable for composing a large number of different messages, and which is simple and economical to manufacture, Further objects and advantages will become apparent from a study of the following description and the accompanying drawings.

In a preferred embodiment of the invention, the sign has a colorless translucent sheet. An aluminum background sheet, which has the legend cut out, is mounted in front of the translucent sheet. A retroreflective portion, which is slightly smaller than the legend cutout, is mounted within the cutout and in front of the translucent sheet, such that the retroreflective portion is surrounded by a translucent border. The retroreflective portion and the translucent border comprise the legend. The background sheet and the retroreflective portion are in highly contrasting colors for maximum legibility.

When the road sign is lit by direct lighting, the highly retroreflective portion of the legend will reflect much of the light such that the information will be clearly seen by drivers. When the sign is strongly backlit by the sun or oncoming headlights, the translucent border of the legend will glow brightly, such that a bright outline of the legend will be clearly seen by drivers.

| DRAWING REFERENCE NUMBERALS | |
|---|---|
| 10. Background Sheet | 11. Legend Segment |
| 12. Cutout | 13. Translucent Sheet |
| 14. Retroreflective Portion | 15. Translucent Border |
| 16. Background Sheet | 17. Legend Segment |
| 18. Cutout | 19. Retroreflective Portion |
| 20. Translucent Border | 21. Retroreflective Pyramids |
| 22. Oblique Light | 23. Bill Board |
| 24. Hole | 25. Retroreflective Panel |
| 26. Opaque Panel | 27. Sign Area |
| 28. Side | 29. Clear Pyramid |
| 30. Flange | 31. Rear Panel |

-continued

| DRAWING REFERENCE NUMBERALS | |
|---|---|
| 32. Screw | 33. Retroreflective Sheet |

DESCRIPTION—FIG. 1

Figure 1:
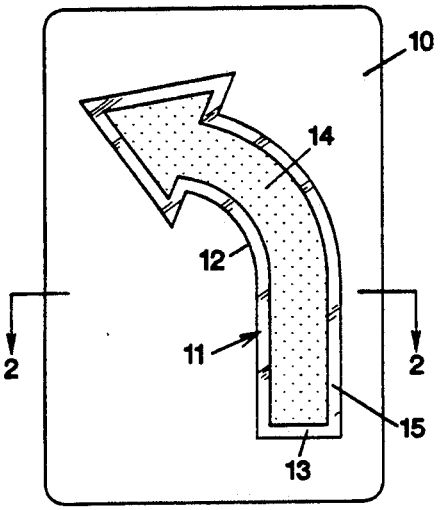
FIG. 1 is front view of a sign in accordance with a preferred embodiment of the invention.

In accordance with a referred embodiment of the invention shown in FIG. 1, a retroreflective road sign comprised an aluminum sheet 10 which has an informational legend segment 11. The example shown is a curved arrow for indicating that the road bends left. Background sheet 10 is thick and strong enough to support the weight of the sign, as well as to withstand strong winds. Background sheet 10 is painted with a moderately retroreflective paint in a bright color, such as red, to make the sign as easy to notice as possible.

Legend segment 11 comprises a cutout 12 in background sheet 10 in the shape of legend segment 11. A translucent sheet 13 (partially shown), which is made of a colorless translucent material such as frosted acrylic sheeting which transmits and diffuses light, is mounted behind background sheet 10 so that only the portion within cutout 12 is visible. Retroreflective portion 14 is shaped similar to cutout 12 but is narrower than the cutout. Retroreflective portion 14 is made of a material which is highly retroreflective and slightly translucent, such as the silverized film sold by TAP Plastics in San Francisco, Calif., under the tradename LLUMAR. Retroreflective portion 14 is mounted on translucent sheet 13, within cutout 12, such that retroreflective portion 14 forms the center of legend 11, while a translucent border 15 is formed around retroreflective portion 14. Retroreflective portion 14 has a color, such as white, which contrasts with the color of background sheet 10 to maximize the legibility of the sign.

DESCRIPTION—FIG. 2

Here the sign of FIG. I is shown in an end sectional view. Background sheet 10, which is mounted on top of translucent sheet 13, has a cutout 12. Retroreflective portion 14, which is smaller than cutout 12, is mounted within cutout 12 and on top of translucent sheet 13. The gap between retroreflective portion 14 and background sheet 10 thus forms translucent border 15.

OPERATION—FIGS. 3 AND 4

Figure 2:
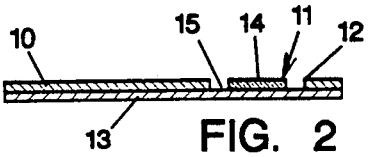
FIG. 2 is an end sectional view of the sign of FIG. 1.
Figure 3:
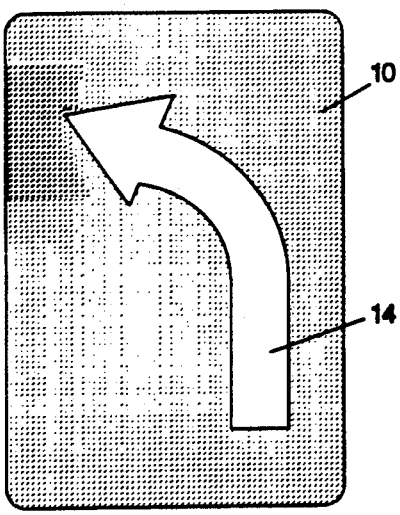
FIG. 3 is a front view of the sign of FIG. 1, when mostly illuminated by direct lighting.

When the sign shown in FIGS. 1 and 2 is illuminated predominately by direct lighting, such as during the day when the sun is generally in front of the sign, or during the night when the front of the sign is directly illuminated by headlights, a driver approaching the front of the sign will see it as shown in FIG. 3. Light striking the front of retroreflective background sheet 10 will be reflected towards the driver such that background sheet 10 will be visible from a distance. Most of the light striking translucent border 15 (not shown) will not be reflected, such that border 15 will be invisible from the same distance. However, retroreflective portion 14, being made of a highly retroreflective material, will reflect much of the light towards the driver. Therefore, under such a lighting condition, a driver approaching the front of the sign will clearly see background sheet 10 and retroreflective portion 14, as shown in FIG. 3.

Figure 4:
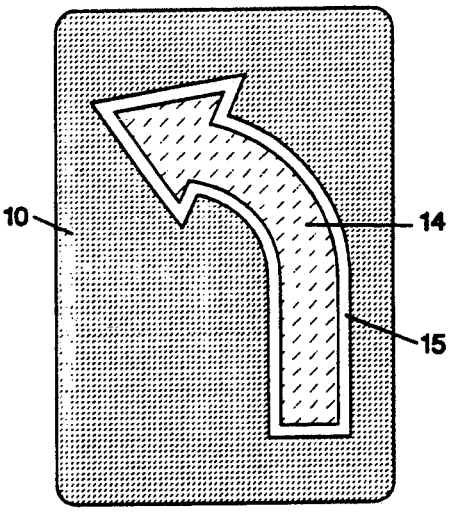
FIG. 4 is a front view of the sign of FIG. 1, when mostly illuminated by back lighting.

When the sign is illuminated predominately by back lighting, such as when the sun is almost directly behind the sign or when headlights are approaching from behind the sign, it will appear as shown in FIG. 4. Strong back lighting will cause background sheet 10 to appear very dark or almost invisible. However, some of the strong back light will be transmitted through retroreflective portion 14 such that it will be moderately visible to a driver at a distance in front of the sign. However, translucent border 15 will transmit and scatter most of the back light striking it, such that border 15 will glow brightly. Therefore, a driver approaching the front of the sign will clearly see border 15 as a bright outline of the information on the sign, as shown in FIG. 4.

The "Curved Arrow" sign shown in FIGS. 1 to 3 is usually used on mountain roads to prevent drivers from inadvertently driving off the edge of the road. In such a situation, the conspicuousness and legibility of the sign under adverse lighting conditions is obviously critical.

DESCRIPTION—FIG. 5

Figure 5:
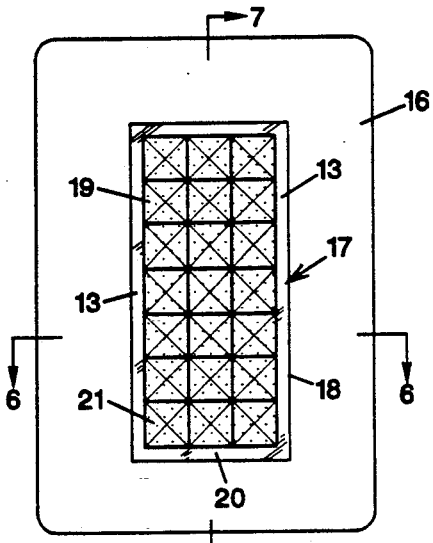
FIG. 5 is a front view of a sign in accordance math another embodiment of the invention.

As shown in FIG. 5, an alternate embodiment of the sign comprises an aluminum background sheet 16 with an informational legend 17. Legend 17 comprises of a cutout 18 in the shape of the legend in background sheet 16. A translucent sheet 13 (partially shown) is mounted behind background sheet 16. A highly retroreflective portion 19, which is of a similar shape to cutout 18 but is smaller than the cutout, is mounted in front of sheet 13 and within cutout 18, such that legend 17 comprises of retroreflective portion 19 and a translucent border 20 around portion 19.

The front surface of portion 19 is composed of many small, square retroreflective pyramids 21, which are arranged in a mosaic to compose legend 17. As shown, legend 17 is a simple rectangle. However, other shapes, symbols, and letters can be easily made by rearranging pyramids 21.

DESCRIPTION—FIG. 6

Here the sign of FIG. 5 is shown in an end sectional view. Background sheet 16 is mounted on top of translucent sheet 13, while retroreflective portion 19 is mounted within cutout 18 of background sheet 16. Retroreflective portion 19 is smaller than cutout 18 such that translucent border 20 is formed around retroreflective portion 19. Retroreflective portion 19 is comprised of three solid pyramids 21 across the width of portion 19. An oblique light 22 is direct at retroreflective portion 19 from the left.

DESCRIPTION—FIG. 7

Here the sign of FIG. 5 is shown in an side sectional view. Background sheet 16 is mounted in front of translucent sheet 13, while retroreflective portion 19 is mounted within cutout 18 and in front of translucent sheet 13. Retroflective portion 19 is comprised of seven solid pyramids 21 across the height of portion 19.

Figure 7:
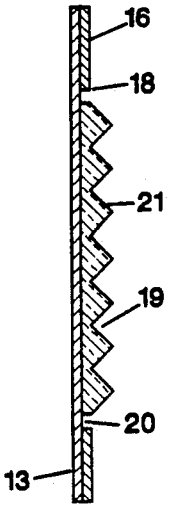
FIG. 7 is a side sectional view of the sign of FIG. 5.
Figure 6:
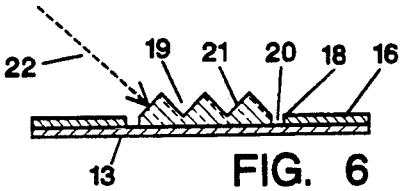
FIG. 6 is an end sectional view of the sign of FIG. 5.

OPERATION—FIGS. 5 to 7

When the sign shown in FIGS. 5 to 7 is illuminated by strong back lighting, translucent border 20 will transmit and scatter most of the light striking it, such that drivers in front of the sign will clearly see translucent border 20 as a bright outline of the information of legend 17.

Referring to FIG. 6, when the sign is illuminated by oblique light 22, such as headlights (not shown) shining at the sign from the left at a shallow angle, light 22 will strike the left sides of pyramids 21 at a generally right angle. As a result, light 22 will be reflected back to the light source, such that a driver approaching the sign at a shallow angle will clearly see portion 19.

DESCRIPTION—FIG. 8

Figure 8:
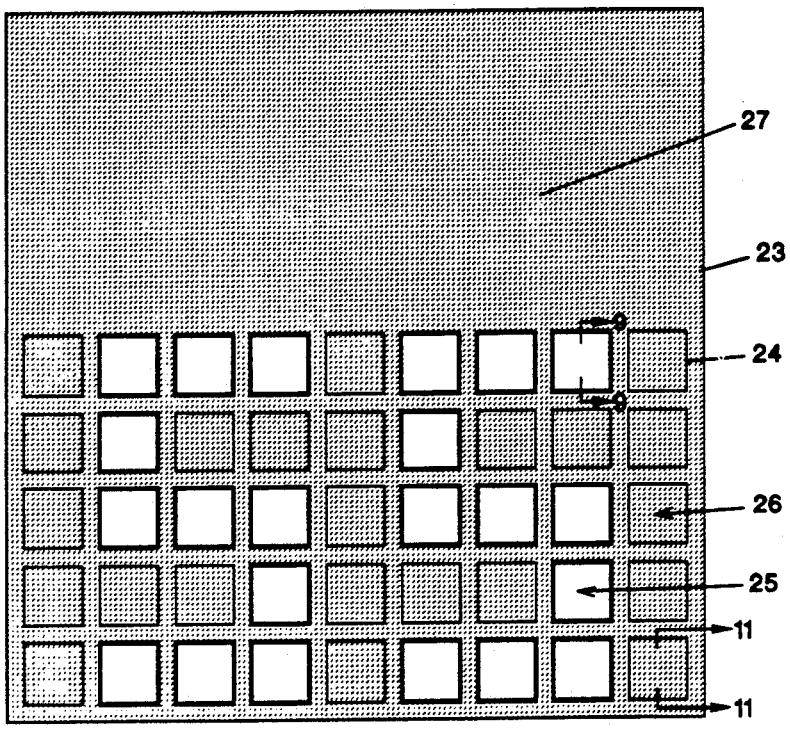
FIG. 8 is a front view accordance with a third embodiment of the invention.
Figure 9:
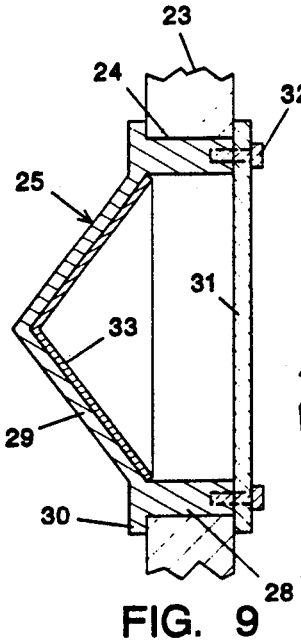
FIG. 9 is a side sectional view of one of the panels in the sign of FIG. 8.
Figure 10:
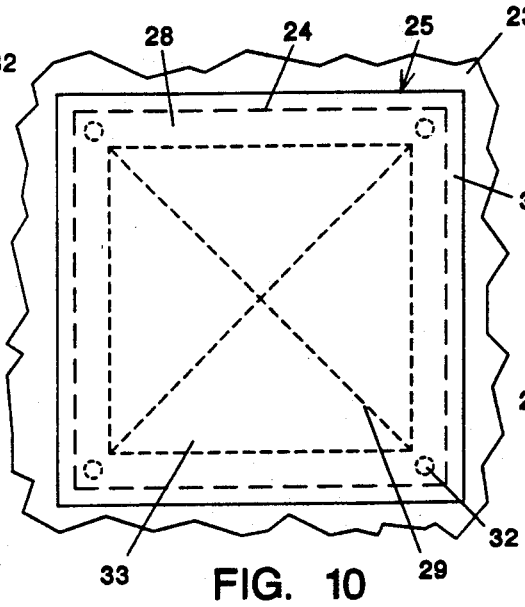
FIG. 10 is a front view of the panel of FIG. 9.
Figure 11:
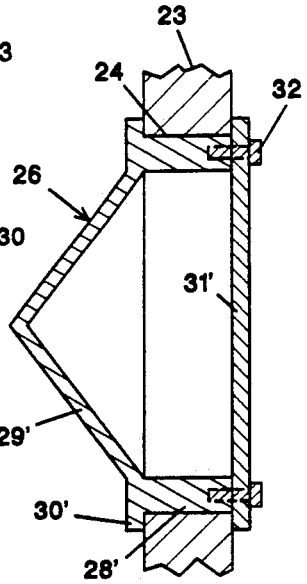
FIG. 11 is a side sectional view of another panel in the sign of FIG. 8.

In yet another embodiment, the sign may be highly customizable by being composed of a bill board 23 with a grid of square holes 24, as shown in FIG. 8. A number of retroreflective square panels 25 are placed into the appropriate squares holes to form a mosaic informational message. The example shown is the number 55, but a wide range of other messages may be easily formed. Opaque panels 26 fill in the rest of the square holes 24. An additional sign area 27 above the grid of holes 24 allows the placement of additional information such as printed graphics. Retroreflective panels 25 are made in bright colors, while opaque bill board 23 and opaque panels 26 are painted in an identical dark color to enhance contrast.

DESCRIPTION—FIG. 9

Here retroreflective panel 25 is shown in a side sectional view. Panel 25 is hollow, and has flat top and bottom sides 28 and a front facing pyramid 29. Panel 25 is secured within a hole 24 of sign board 23 by an integral flange 30 around the perimeter of pyramid 29 and a rear panel 31, which is secured to sides 28 by screws 32. Flange 30 and rear panel 31 are slightly larger than hole 24, such that they engage the front and rear surfaces, respectively, of sign board 23 to secure panel 25 in place. A retroreflective sheet 33 is attached to the inside surface of pyramid 29.

Pyramid 29 and sides 28 are made in a single piece in a highly transparent material such as acrylic, while rear panel 31 is made of a translucent material such as frosted or translucent colored acrylic. Retroreflective sheet 33 is made of silver LLUMAR, which is mostly retroreflective but partially translucent. Panels 25 may be made in various bright colors for enhancing the attractiveness and legibility of the informational message.

DESCRIPTION—FIG. 10

Panel 25 is shown here in a front view. When the panel is illuminated by frontal lighting, retroreflective sheet 33 under pyramid 29 will reflect much of the light back to the source. But when light is predominately directed at the rear of panel 25, some of the light will be transmitted through rear panel 3 1 and retroreflective sheet 3 3, such that pyramid 29 will glow moderately. However, the four transparent sides 28 will transmit all of the diffused light passing through translucent rear panel 3 1, so that sides 28 will glow as a very bright border around pyramid 29.

DESCRIPTION—FIG. 11

Here opaque panel 26 is shown in a side sectional view. Panel 26 has sides 28', a pyramid 29', a flange 30', and a rear panel 31'. It is exactly the same as panel 25, except panel 26 is made entirely of an opaque material such as colored or painted ABS plastic, and has no retroreflective sheet installed.

While the above descriptions are specific, they should not be considered as limitations on the scope of the invention, but only as examples of the embodiments. Many other ramifications and variations are possible within the teachings of the invention. For example, different materials may be used. Translucent sheet 13 may be sized and shaped to be just larger than cutout 12 to minimize cost. Pyramids 21 and 29 may be replaced with other polyhedrons or round domes. Other types of fasteners may be used in place of screws 32. Thus, the reader is requested to determine the scope of the invention by the appended claims and their legal equivalents, and not by the examples given.

I claim:

1. A sign, comprising:

a background sheet having a cutout of an outline of an informational legend, said background sheet having a front side and a rear side, said cutout having a perimeter, a substantially retroreflective portion fitted within said cutout, said retroreflective portion having a periphery, said retroreflective portion being smaller than said cutout so that a substantial gap is formed between said perimeter of said cutout and said periphery of said retroreflective portion, said retroreflective portion having a front side for reflecting a substantial amount of a direct light striking said front side of said retroreflective portion, said retroflective portion having a rear side, and a translucent sheet attached to said rear side of said background sheet and said rear side of said retroflective portion, so that said translucent sheet has a visible portion within said gap between said cutout and said retroreflective portion as seen from said front side of said background sheet, said visible portion of said translucent sheet having front and rear surfaces, such that when said rear surface of said visible portion is illuminated by a back light, said visible portion will transmit and diffuse said back light such that said front surface of said visible portion will glow.

2. The sign of claim 1 wherein said retroreflective portion comprises a plurality of retroreflective convex shapes arranged on said front side of said retroreflective portion.

3. The sign of claim 2 wherein said convex shapes are pyramids.

* * * * *